US007146772B2

(12) United States Patent
Ralf

(10) Patent No.: US 7,146,772 B2
(45) Date of Patent: Dec. 12, 2006

(54) PANEL AND LOCKING SYSTEM FOR PANELS

(75) Inventor: Eisermann Ralf, Cochem (DE)

(73) Assignee: Akzenta Paneele + Profile GmbH, Kaisersesch (DE)

( * ) Notice: Subject to any disclaimer, the term of this patent is extended or adjusted under 35 U.S.C. 154(b) by 0 days.

(21) Appl. No.: 10/245,611

(22) Filed: Sep. 17, 2002

(65) Prior Publication Data

US 2003/0188504 A1 Oct. 9, 2003

(30) Foreign Application Priority Data

Apr. 4, 2002 (DE) ..... 102 14 972

(51) Int. Cl.
*E04B 2/08* (2006.01)

(52) U.S. Cl. ..... 52/592.1; 52/588.1

(58) Field of Classification Search ..... 52/592.1, 52/588.1, 581, 591.1
See application file for complete search history.

(56) References Cited

U.S. PATENT DOCUMENTS 6,209,278 B1 * 4/2001 Tychsen ..... 52/592.4
6,490,836 B1 * 12/2002 Moriau et al. ..... 52/589.1
6,505,452 B1 * 1/2003 Hannig et al. ..... 52/582.1
6,591,568 B1 * 7/2003 Pålsson ..... 52/592.2
6,606,834 B1 * 8/2003 Martensson et al. ..... 52/578

* cited by examiner

*Primary Examiner*—Basil Katcheves
(74) *Attorney, Agent, or Firm*—Whiteford, Taylor & Preston LLP; Jeffrey C. Maynard; Gregory M. Stone

(57) ABSTRACT

The invention relates to a panel and a locking system (1) for panels (2, 3) with edge profiles provided on at least two opposite edges of the panels (2, 3) for the positive connection of similar panels (2, 3), including an edge profile designed as a groove profile (4), with an upper groove wall (6) and a lower groove wall (7), and an edge profile designed as a tongue profile (5), with a notch projection (12) on the underside of the tongue that engages a notch recess (11) in the lower groove wall (7) of an adjacent panel in the assembled state, where the engaged edge profiles form an articulated joint (G) that acts to restore the panels (2, 3) to their installation plane when deflected either up or down, where the upper groove wall (6) has a flank (21) on the inside that opens towards the free end of the groove wall (6).

15 Claims, 4 Drawing Sheets

PANEL AND LOCKING SYSTEM FOR PANELS

BACKGROUND OF THE INVENTION

1. Field of the Invention

The invention relates to a locking system for panels with edge profiles provided on at least two opposite edges of the panels for the positive connection of similar panels, including an edge profile designed as a groove profile, with an upper groove wall and a lower groove wall, and an edge profile designed as a tongue profile, with a notch projection on the underside of the tongue that engages a notch recess in the lower groove wall of an adjacent panel in the assembled state, where the engaged edge profiles form an articulated joint that acts to restore the panels to their installation plane when deflected either up or down. The invention also relates to a panel with the locking system according to the invention.

2. Background of the Prior Art

Locking systems of this kind are used for floor panels, for example, such as parquet panels with a natural wood surface or laminated panels. The latter have a core made of MDF, HDF or particle board and are provided with a reproduced surface made of a decorative laminate.

299 11 462 U1 discloses a generic locking system, whose connection has the function of an articulated joint. Locking systems of this kind are used for floor coverings, which, for example, lie on uneven bases or must bear deflection in the connection area due to the presence a soft backing, such as impact sound insulation. Deflection of the connection causes high stresses in the region of the tongue-and-groove profiles of two locked panels, because the connection bends under the load. The panel material cannot withstand the high stresses in the region of the edge profiles and fails in the connection area.

The ease of installation of the known jointed locking system leaves much to be desired. Its resistance to being pulled apart in the installation plane does not meet expected, future quality standards for floor coverings with mechanical locking systems. Furthermore, the known joint connection can be installed in two ways, where the second installation method described is associated with the undesirable side effect that the connection displays particularly low resistance to being pulled apart.

According to the first installation method, a new panel, preferably tongue-first, is placed at an angle against a laid panel and then folded or rotated downwards until it lies in the common installation plane of the panels and locks automatically.

In the second installation method, locking occurs when both panels are in the installation plane, namely by sliding the panels laterally towards one another. The panels can only be joined together in this way because the undercut between the notch projection of the tongue and the notch recess in the lower groove wall is designed to be correspondingly small. The notch connection achieved in this way is of such low strength that gaps can form between abutting surfaces of adjacent panels due to normal changes in length of the floor. This is the case, for example, when the temperature of the floor fluctuates. This method of jointing also results in immediate damage to the edge profiles, because they must be subjected to strong deformation in order for the undercut of the tongue and the lower groove wall to engage.

Furthermore, the tongue of the known locking system has a long, tapered shape. The top of the tongue has an inclined surface that is intended to facilitate insertion of the tongue tip into the groove. In reality, however, the tongue proves to be very easily damaged due to its tapered shape. This has a disadvantageous effect on the product's ease of installation, service life and utility.

The object of the invention is to design a locking system for an articulated panel connection, which is easier to handle, displays greater resistance to being pulled apart and has a longer service life than the known locking system.

According to the invention, the object is solved in that the upper groove wall has a flank on the inside that opens towards the free end of the groove wall.

Providing a flank on the upper groove wall creates a wide groove opening on the groove side of a panel, into which the tongue profile of an adjacent panel can be inserted more easily than the known, tapered tongue profile into the narrower groove opening of the known locking system.

The flank preferably transitions into a levelling surface extending towards the groove base, which ensures exact vertical positioning without vertical offset between locked panels. In other words, the segment of the inside of the upper groove wall running from the flank to the base of the groove forms the levelling surface, the distance of which to the surface of the panel is precisely equal to the distance of the top side of the tongue to the surface of the panel, meaning that no vertical offset occurs between locked panels.

The flank can be of curved or plane design, where a straight shape is expedient for manufacturing purposes and a curved shape is somewhat more favourable for the panel joining procedure in terms of stress. When the tongue profile comes into contact with the curved flank of the groove profile, the surface pressure is somewhat lower than in the case of contact between the tongue profile and the edge on the end of the plane flank.

A levelling surface is also provided on the top side of the tongue, which interacts with the levelling surface of the upper groove wall when the panels are joined. Since the upper groove wall has a flank on the free, front end, the levelling surface of the tongue is only in partial contact with the levelling surface of the upper groove wall, namely in the region of the free end of the tongue. If the levelling surface of the tongue were in contact with the upper groove wall along the entire length of the top tongue surface, a rigid connection would result. The flank lends the connection a degree of flexibility that favours the joint function of the connection and reduces stress in the material of the edge profiles.

In the event of deflection of the connection towards the installation base, in particular, the flank creates room for movement, so that the top side of the tongue can be moved towards the flank without coming up against it prematurely. The flexibility of the connection achieved in this way enables articulated movement without rupturing the tongue or damaging the groove walls due to excessive stress.

The handling and service life of the locking system are improved if the tongue length, meaning the distance by which the tongue protrudes beyond the upper edge of the panel, is less than or equal to the thickness of the upper groove wall of the groove profile. A tongue of this length is short compared to the prior art. The short tongue has the advantage that only a relatively short insertion path has to be travelled when the tongue is inserted at an angle into a groove profile. Consequently, the proposed locking system is particularly easy to handle during installation and can be installed much more quickly than the known locking system.

The tongue has a blunt surface on its free end, which is more robust and durable compared to the tapered shape of the tongue of the known locking system.

The groove depth of the groove profile, meaning the distance the groove recedes beyond the upper edge of the panel, is favourably greater than the tongue length described above by roughly half. In other words, if the groove depth starting from the upper edge of the panel is ⅔, the tongue protrudes into the groove by a tongue length of ⅔ when two panels are assembled, leaving a space with a residual depth of ⅓ the groove depth between the free end of the tongue and the groove base. Such a large groove depth would not be necessary to simply accommodate the tongue in the groove. However, the large groove depth influences the flexible length of the lower groove wall protruding freely from the edge of the one panel. This makes the connection flexible, reduces stress in the material and thus increases the service life of the connection.

The flexible length of the lower groove wall preferably roughly corresponds to the thickness of the panel. This is because the spring travel required on the free end of the lower groove wall is then relatively short referred to the length of the tongue, and the elastic expansion occurring during joining of the panels causes only little stress in the material, which can be withstood without difficulty.

The depth of the recess in the lower groove wall expediently amounts to roughly one-third the thickness of the tongue. This results in a degree of undercut in the assembled state that prevents the panels from being pulled apart in installed state under normal conditions of use. Compared to conventional mechanical locking systems according to the prior art, which are locked by means of horizontal sliding in the installation plane, the degree of undercut of the locking system according to the invention is roughly doubled and, as a result, the resistance of panels against being pulled apart in the installation plane dramatically increased.

For the purpose of material-saving manufacture, the offcut dimensions on the edges of the panels are relatively small. They preferably differ on the groove side and the tongue side.

On the groove side of a panel, the resulting offcut of the decorated surface is favourably less than half the panel thickness.

On the tongue side of a panel, the resulting offcut of the decorated surface is preferably roughly between ⅓ and ¼ the thickness of the panel. It essentially corresponds to the length the tongue protrudes beyond the upper edge of the panel.

A panel, particularly a floor panel, is expediently equipped with a locking system according to the invention. The locking profile is preferably used for laminated flooring panels, which comprise a core material made of HDF, MDF or particle board, where the edge profiles of the locking system are milled into the edges of the panels.

BRIEF DESCRIPTION OF THE DRAWINGS

An example of the invention is illustrated in a drawing and described in detail below on the basis of figures. The figures show the following.

DETAILED DESCRIPTION OF THE PREFERRED EMBODIMENTS

Figure 1:
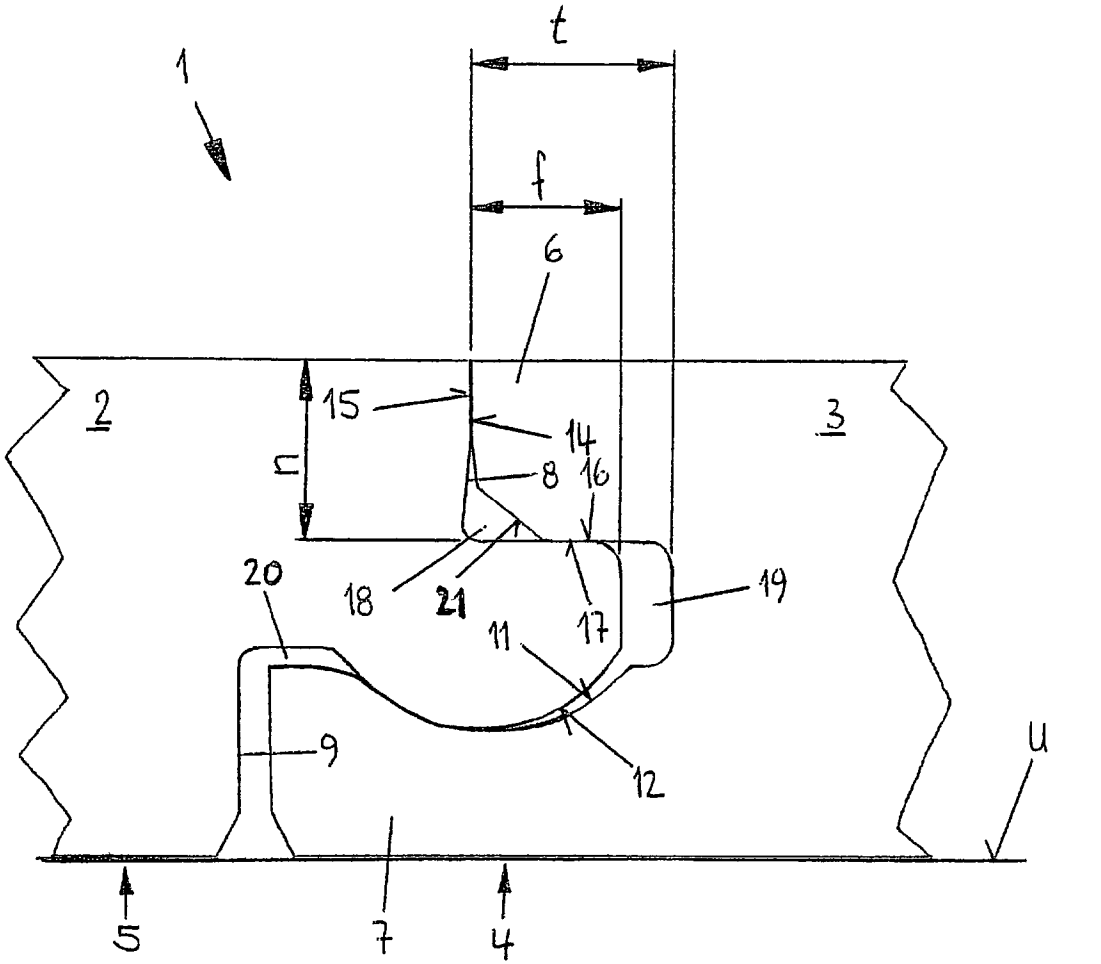
FIG. 1: A locking system consisting of a tongue profile and a groove profile of two joined panels.

According to the drawing, locking system 1 consists of two positively engaging edge profiles provided on the edges of panels 2 and 3. The edge profiles are largely designed to be complementary to one another as groove profile 4 and tongue profile 5. Groove profile 4 on one edge of a panel 2 or 3 is always opposite a tongue profile 5 on the opposite edge of the same panel 2 or 3. In this way, identically profiled panels 2 and 3 can be connected to one another. Locking system 1 is expediently provided on all opposing sides of a panel 2 or 3.

The configuration described relates to floor panels equipped with the locking system according to the invention. Of course, the locking system can also be used for wall and ceiling panels, or for panels for fence or house construction, where the problem of deflection occurs to a lesser degree.

FIG. 1 shows that the locking system according to the invention involves a modified tongue-and-groove profile. Groove walls 6 and 7 of groove profile 4 protrude different distances beyond the edge of panel 3. Segments 8 and 9 adjacent to tongue 10 of tongue profile 5 recede different distances beyond the edge of panel 2. Protruding groove walls 6, 7 and receding areas 8, 9 of groove profile 4 and tongue profile 5 are adapted to one another such that they can be joined. In order to secure the lock against panels 2 and 3 being pulled apart in the installation plane, a concave notch recess 11 is incorporated on the inside of lower groove wall 7 that is engaged by a convex notch projection 12 in the assembled state according to FIG. 1. Convex notch projection 12 is provided on the underside of tongue 10 facing installation base U. On the free, protruding end of lower groove wall 7, a shoulder 13 provides resistance to tongue 10 of panel 2 being pulled out of groove profile 4 of adjacent panel 3 in the horizontal plane.

FIG. 1 further shows that the edges of the edge profiles only contact one another in three areas. The first is the upper edge of the two panels 2 and 3 facing away from installation base U, where a tight, gapless joint is located. Abutting surfaces 14 and 15 are in contact here. The second contact area is the one between the top side of the tongue and the inside of the upper groove wall no more than 25 percent of the upper surface of the upper tongue surface contact the upper groove wall. Here, levelling surfaces 16 and 17 of the two edge profiles are in contact with one another, where both levelling surface 16 of tongue 10 and levelling surface 17 of upper groove wall 6 are at exactly the same distance from the top side of the respective panel 2 or 3. A vertical offset between joined panels 2 and 3 is avoided in this way. The third contact area is the contact between concave notch recess 11 of lower groove wall 7 and convex notch projection 12 of tongue 10. This contact area is located on the part of notch recess 11 facing the free end of lower groove wall 7. Generously dimensioned spaces 18, 19 and 20 are provided between these contact areas, meaning that contact really only ever occurs at the desired contact areas, a gapless, tight joint is ensured on the top side of the floor covering, and no vertical offset occurs.

In the present practical example, plane flank 21 is provided on the inside of upper groove wall 6, the result being that only in the region of its free end does the top side of the tongue act as levelling surface 16, which is in contact with levelling surface 17 of upper groove wall 6. FIG. 1 shows tongue length f, by which tongue 10 protrudes beyond the upper edge of panel 2. This tongue length f is less than or equal to thickness n of upper groove wall 6. In this case, the protrusion of tongue 10 is relatively small. Inclined flank 21 on upper groove wall 6 results in the formation of mouth-like opening 22, into which short tongue 10 can be inserted very easily. Moreover, short tongue 10 results in a very short insertion path until tongue 10 is completely inserted in the groove. The manual assembly of panels equipped with this locking system is very simple and substantially faster than with panels provided with the known locking system.

Groove depth t, by which the groove recedes beyond the upper edge of panel 3, is greater than tongue length f by roughly half. A groove depth t of this kind would not be necessary to accommodate tongue 10. However, it promotes the flexibility of groove walls 6 and 7, particularly of lower groove wall 7, which must be slightly elastically expanded in order to join panels 2 and 3. The elasticity of the material results in a restoring action. Panels 2 and 3 spring back into the initial position shown in FIG. 1, in which both panels are located in a common plane. Resulting space 19 further serves to accommodate dirt particles that can get into the joint during installation of panels 2 and 3. In addition, the joint can be improved by adding glue in space 19, in which case, however, the joint characteristics of the connection change, depending on the glue selected.

Figure 2:
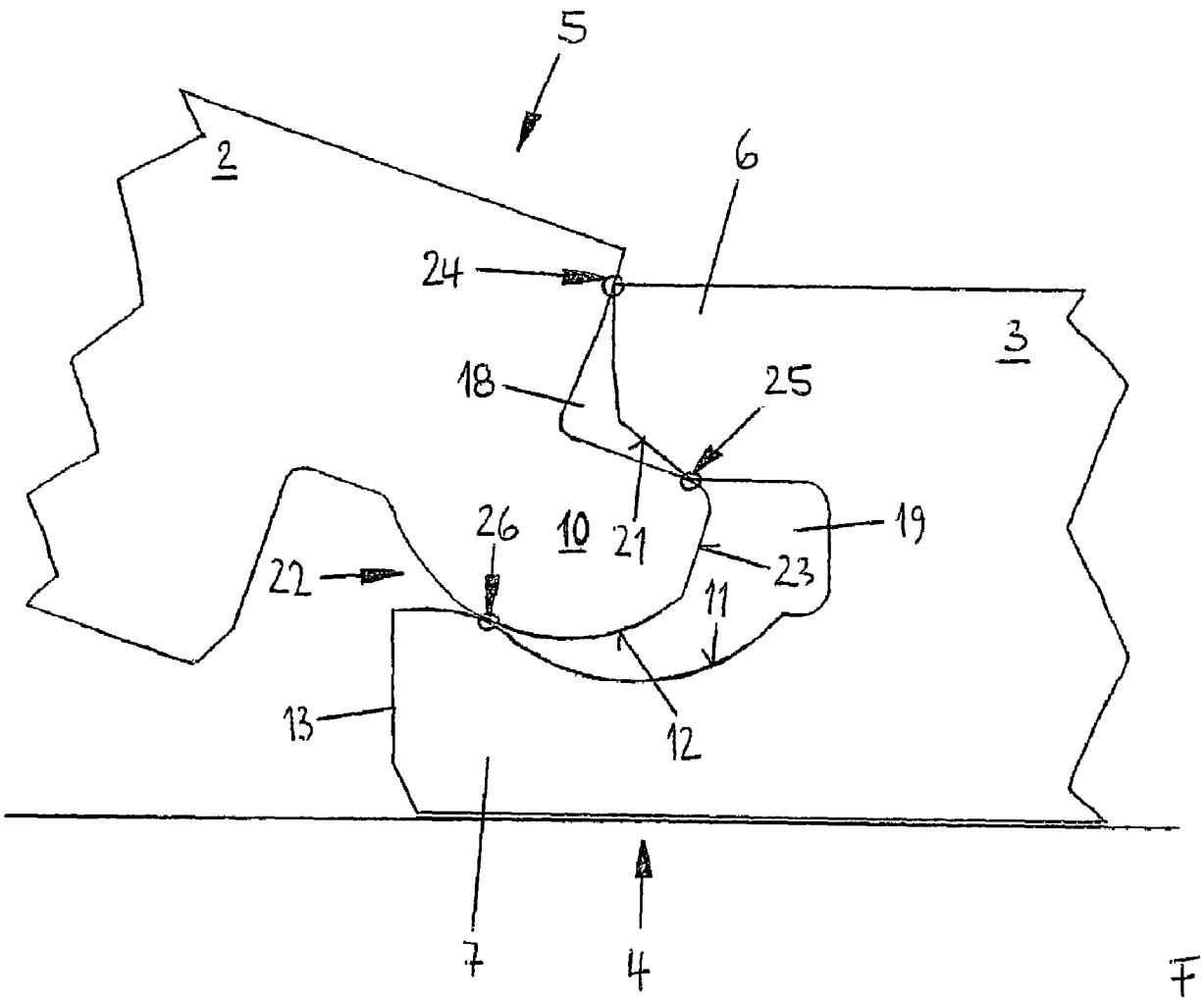
FIG. 2: The locking system according to FIG. 1 during joining.

FIG. 2 shows the positioning of panel 2 with tongue profile 5 against groove profile 4 of panel 3, which is already located on installation base U.

Blunt, free end 23 of tongue 10 can be inserted very easily at an angle and over a short insertion path into groove profile 4 of laid panel 3, which has wide, mouth-like opening 22 due to the flank. Three contact points result in the initial position of the joining motion, as shown in FIG. 2. A first edge contact 24 is formed on the upper edge of panels 2 and 3. A second edge contact 25 is formed between the top side of the tongue and upper groove wall 6, and a third contact 26 between convex notch projection 12 of tongue 10 and concave notch recess 11 of lower groove wall 7. Starting in the position shown in FIG. 2, continuation of the joining procedure causes minimal expansion, essentially due to the elastic deflection of lower groove wall 7 towards installation base U. In this way, convex notch projection 12 of tongue 10 is moved into notch recess 11 of lower groove wall 7 and the final position of panels 2 and 3 reached, as shown in FIG. 1. In this position, notch projection 12 of tongue 10 engages the shoulder of lower groove wall 7 and ensures a secure hold against pulling apart in the horizontal plane.

Figure 3:
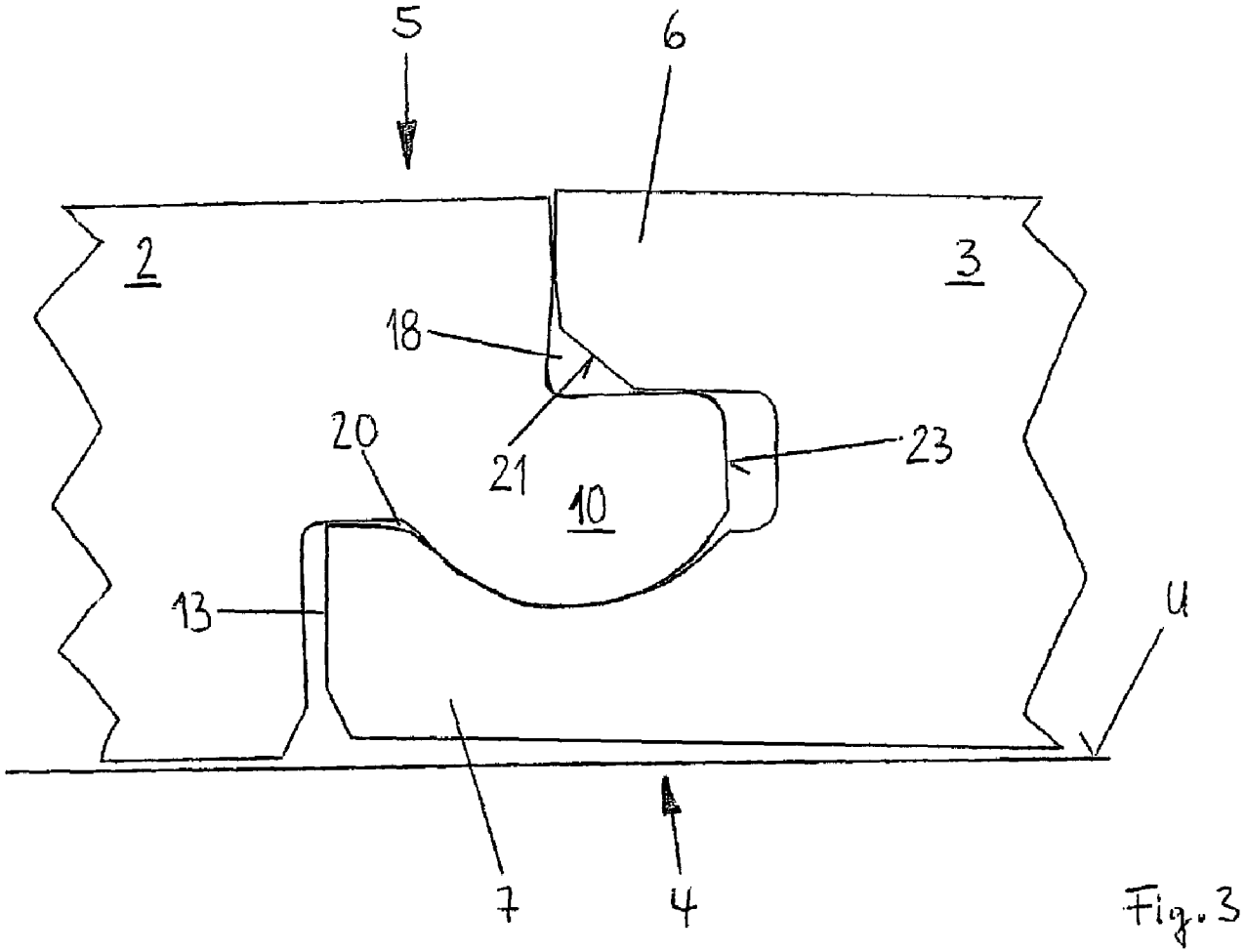
FIG. 3: The locking system according to FIG. 1, where the articulated connection is lifted off the base and deflected upwards.
Figure 4:
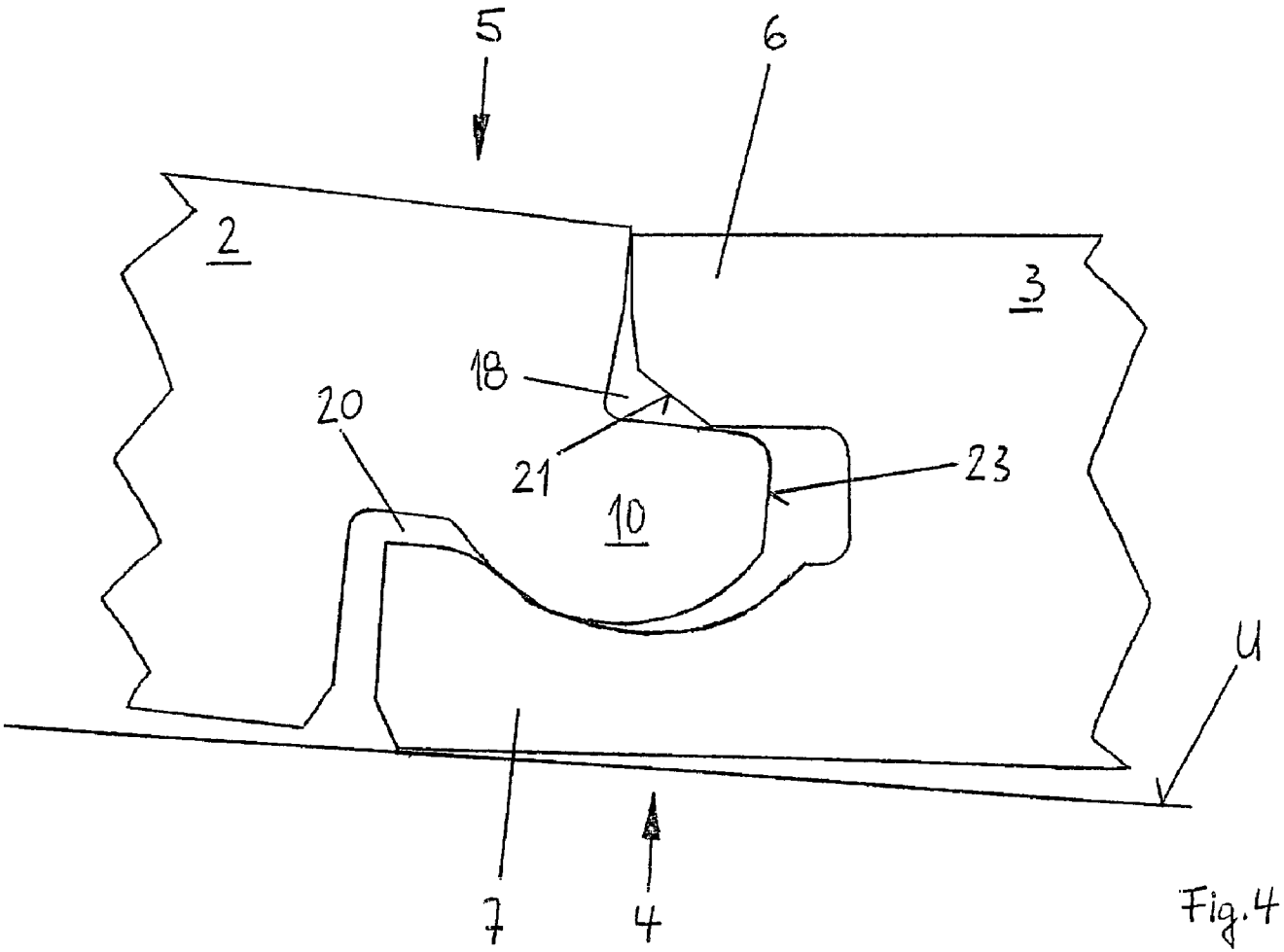
FIG. 4: Locking system according to FIG. 1 with a joint deflected downwards towards the installation base.

FIGS. 3 and 4 show locking system 1 in such a way that the joint function of the connection is apparent.

Locking system 1 is used, for example, for floor coverings lying on uneven installation bases U. With uneven installation bases U of this kind, it can occur that panels 2 and 3 have no contact with the ground in the region of a joint and a space exists. When a load is applied in the region of the joint, it bends. Consequently, deflection of the edge profiles must be tolerable in the joint region. The joint may also bend on a level installation base U. This can happen when panels 2 and 3 are laid on a soft backing, such as impact sound insulation.

In order to withstand such loads, design measures are provided that lend the joint the articulated flexibility it needs. This flexibility prevents deflection of the joint from causing such high stresses in the region of groove profile 4 and tongue profile 5 that the material of panels 2 and 3 fails under the high stress. The positions shown in FIGS. 3 and 4 are arbitrary positions of movement and do not represent limit positions of the joint motion.

FIG. 3 shows the joint deflected upwards, i.e. a way from installation base U. In this position, slight elastic deflection again occurs essentially on lower groove wall 7. Due to its elasticity, lower groove wall 7 has a restoring effect on panels 2 and 3, as soon as the load is removed. The movement of the joint reduces space 20 between the root of tongue 10 and shoulder 13 of lower groove wall 7. In this way, existing space 20 permits articulated flexibility of the joint. In contrast, space 18 becomes larger.

FIG. 4 shows deflection of the locking system in the opposite direction, towards installation base U. Elastic expansion, essentially of lower groove wall 7, is again evident in this case, which likewise has a restoring effect on panels 2 and 3 when the load is removed. The movement of the joint reduces space 18 between tongue 10 and flank 21 of upper groove wall 6.

In this case, space 18 permits the articulated flexibility of the joint. In contrast, space 20 becomes larger.

Panel and Locking System for Panels

| List of reference numbers | |
|---|---|
| 1 | Locking system |
| 2 | Panel |
| 3 | Panel |
| 4 | Groove profile |
| 5 | Tongue profile |
| 6 | Upper groove wall |
| 7 | Lower groove wall |
| 8 | Segment |
| 9 | Segment |
| 10 | Tongue |
| 11 | Concave notch recess |
| 12 | Convex notch projection |
| 13 | Shoulder |
| 14 | Abutting surface |
| 15 | Abutting surface |
| 16 | Levelling surface |
| 17 | Levelling surface |
| 18 | Space |
| 19 | Space |
| 20 | Space |
| 21 | Flank |
| 22 | Mouth-like opening |
| 23 | Blunt end |
| 24 | Edge contact |
| 25 | Edge contact |
| 26 | Contact |
| f | Tongue length |
| n | Thick, upper groove wall |
| p | Groove depth |
| U | Installation base |

The invention claimed is:

1. A panel locking system with edge profiles provided on at least two opposite edges of the panel for the positive connection of similar panels, wherein one of the opposite edges of the panel has an edge profile designed as a groove profile, with an upper groove wall, a lower groove wall, and a base, said upper groove wall having an abutting surface and a flank, and wherein the second of the opposite edges of the panel has an edge profile designed as a tongue profile with a tongue having a notch projection on the underside of the tongue that engages a notch recess in the lower groove wall of an adjacent panel in the assembled state, wherein the lower groove wall must be slightly elastically expanded in order to join adjacent panels, such that the engaged edge profiles form an articulated joint that acts to restore the panels to their installation plane when deflected either up or down, the flank comprises an angularly displaced face formed on a lower portion of the upper groove wall such that, in the assembled state, no more than 25 percent of the upper surface of the tongue is in contact with the upper groove wall and only in the region of the distal end of the tongue.

2. The panel locking system according to claim 1, characterized in that the flank is of curved or plane design.

3. The panel locking system according to claim 1, characterized in that the flank transitions into a leveling surface extending towards the groove base.

4. The panel locking system according to claim 1, characterized in that a leveling surface is provided on the top side of the tongue, which interacts with a leveling surface of the upper groove wall when panels are joined.

5. The panel locking system according to claim 1, characterized in that the tongue length, meaning the distance by which the tongue protrudes beyond the upper edge of the panel, is less than or equal to the thickness of the upper groove wall of the groove profile.

6. The panel locking system according to claim 5, characterized in that the groove depth, meaning the distance the groove base recedes beyond the upper edge of the panel, is greater than the tongue length by approximately half.

7. The panel locking system according to claim 1, characterized in that the lower groove wall displays a flexible length approximately corresponding to the thickness of the panel.

8. The panel locking system according to claim 1, characterized in that the depth of the notch recess in the lower groove wall is approximately one-third the thickness of the tongue.

9. The panel locking system according to claim 1, said panel having a decorated surface on a top portion thereof, said locking system characterized in that, on the groove side of a panel, the decorated surface is offcut by an amount less than half the panel thickness.

10. The panel locking system according to claim 1, said panel having a decorated surface on a top portion thereof, said locking system characterized in that, on the tongue side of a panel, the decorated surface is offcut by an amount approximately between ⅓ and ¼ the thickness of the panel.

11. The panel locking system according to claim 1, characterized in that the lower groove wall is distally longer than the upper groove wall.

12. The panel locking system according to claim 1, characterized in that the distance by which the tongue protrudes beyond the upper edge of the panel is less than the distance by which the tongue protrudes beyond the lower edge of the panel.

13. The panel locking system according to claim 1, characterized in that spaces are provided between points of contact of the groove profile and the tongue profile.

14. A panel with a locking system on at least two opposite edges of the panel for the positive connection of similar panels, wherein one of the opposite edges of the panel has an edge profile designed as a groove profile, with an upper groove wall, a lower groove wall, and a base, said upper groove wall having an abutting surface and a flank, and wherein the second of the opposite edges of the panel has an edge profile designed as a tongue profile with a tongue having a notch projection on the underside of the tongue that engages a notch recess in the lower groove wall of an adjacent panel in the assembled state, wherein the lower groove wall must be slightly elastically expanded in order to join adjacent panels, such that the engaged edge profiles form an articulated joint that acts to restore the panels to their installation plane when deflected either up or down, the flank comprises an angularly displaced face formed on a lower portion of the upper groove wall such that, in the assembled state, no more than 25 percent of the upper surface of the tongue is in contact with the upper groove wall and only in the region of the distal end of the tongue.

15. The panel according to claim 14, characterized in that the panel substantially comprises MDF, HDF, or chipboard material.

* * * * *